United States Patent [19]

Hort et al.

[11] 4,419,266

[45] Dec. 6, 1983

[54] CORROSION INHIBITORS CONTAINING 3-DIALKYL-3-(1-ETHYLPENTYL)-PROP-1-YNE

[75] Inventors: Eugene V. Hort, Wayne; Lowell R. Anderson, Morristown; Dru W. Alwani, Wayne, all of N.J.

[73] Assignee: GAF Corporation, New York, N.Y.

[21] Appl. No.: 352,295

[22] Filed: Feb. 25, 1982

[51] Int. Cl.[3] ..... C23F 11/14

[52] U.S. Cl. ..... 252/392; 106/14.15; 252/8.55 C; 252/8.55 E; 252/149; 252/390; 252/396; 422/12; 422/16; 564/509; 585/855

[58] Field of Search ..... 252/392, 390, 396, 8.55 C, 252/8.55 E, 149, 180, 181; 106/14.15, 14.42, 14.44; 422/12, 16; 585/855; 564/509

[56] References Cited

U.S. PATENT DOCUMENTS

| | | | |
|---|---|---|---|
| 3,268,583 | 8/1966 | Moore et al. | 564/509 |
| 3,278,530 | 10/1966 | Doyle | 564/509 |
| 3,437,663 | 8/1969 | Viehe | 564/509 |
| 3,439,038 | 4/1969 | Viehe | 564/509 |
| 3,496,232 | 2/1970 | Tedeschi et al. | 252/390 |
| 3,920,759 | 11/1975 | Hort | 568/855 |
| 4,002,694 | 1/1977 | Hort | 568/874 |
| 4,117,248 | 9/1978 | Prater | 568/855 |
| 4,119,790 | 10/1978 | Hort | 568/855 |
| 4,387,041 | 6/1983 | Hort et al. | 252/392 |
| 4,387,042 | 6/1983 | Hort et al. | 252/392 |

*Primary Examiner*—Irwin Gluck

*Attorney, Agent, or Firm*—Marilyn J. Maue; J. Gary Mohr; Joshua J. Ward

[57] ABSTRACT

An aqueous composition for inhibiting the corrosion of metals is described. The composition comprises a non-oxidizing acid, and, as a corrosion inhibitor, an effective amount of a 3-dialkylamino-3-(1-ethylpentyl)prop-1-yne.

18 Claims, No Drawings

CORROSION INHIBITORS CONTAINING 3-DIALKYL-3-(1-ETHYLPENTYL)-PROP-1-YNE

BACKGROUND OF THE INVENTION

1. Field of the Invention

This invention relates to compositions for inhibiting the corrosion of metals placed therein, and to novel acetylenic amines for such use.

2. Description of the Prior Art

In the field of oil-welling acidizing, it is necessary to use inhibitors to prevent corrosion of the oil-well equipment by the acid solutions employed. Many different acetylenic amines have been proposed or used as corrosion inhibitors for oil-well acidization; see e.g. U.S. Pat. Nos. 2,997,507; 3,079,345; 3,107,221; 3,231,507; 3,268,524; 3,268,583; 3,382,179; 3,428,566; 3,496,232; 3,705,106; 3,722,208; 3,779,935; 3,802,890; 3,816,322; and 4,002,694; and the articles entitled "Ethynylation" by W. Reppe, et al. Ann. Chem. 59B, 1-224 (1955); and "Acetylenic Corrosion Inhibitors" by Foster et al., Ind. and Eng. Chem., 51, 825-8 (1959).

Nonetheless, there has been a continuing search for new materials which are highly effective in such application. More particularly, it is desired to provide new and improved corrosion inhibitors which are particularly advantageous in commercial use to prevent corrosion of metals in highly acid solutions, even after prolonged periods of use, which have a low vapor pressure and relatively high stability so that they can be employed at the high temperatures which prevail in modern deep drilling operations, which function effectively at low concentrations, and which are relatively inexpensive to make.

SUMMARY OF THE INVENTION

What is described herein is an aqueous composition for inhibiting the corrosion of metals placed therein which comprises: (a) a 3-dialkylamino-3-(1-ethylpentyl)prop-1-yne compound as a corrosion inhibitor having the formula:

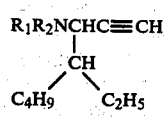

where $R_1$ and $R_2$ are independently alkyl $C_1$–$C_6$, or phenyl; and (b) a non-oxidizing acid.

The compounds of the invention are made by a catalytic reaction, followed by purification, such as by molecular distillation of the crude reaction product under vacuum, or liquid chromatography.

DETAILED DESCRIPTION OF THE INVENTION

The catalytic ethynylation reaction between a dialkylamine, 2-ethylhexanal and acetylene, to produce the desired 3-dialkylamino-3-(1-ethylpentyl)prop-1-yne, proceeds as follows:

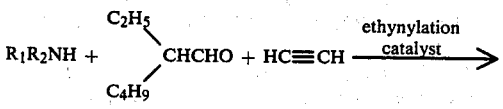

-continued

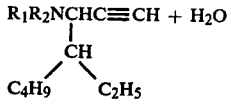

where $R_1$ and $R_2$ are as defined above.

The reaction is carried out in the presence of an ethynylation catalyst, such as is used for commercial preparation of butynediol; see, e.g. U.S. Pat. Nos. 3,920,759; 4,117,248; and 4,119,790. The preferred catalyst is a complex cuprous acetylide prepared from a precursor containing about 5 to 35% by weight of copper, and 2-3% by weight of bismuth, as the oxides, on a magnesium silicate carrier. However, many other ethynylation catalysts and carriers known in the art may be used as well.

The ethynylation reaction can be run under either low or high pressure conditions, i.e. a partial pressure of acetylene, as is used for butynediol, generally from about 0.1 atmosphere to 20 or more atmospheres, either in a stirred reactor with a slurried catalyst, or in a fixed bed, through which the acetylene and the solution are passed.

The ethynylation process preferably is run in a solvent in which the reactants are at least partially soluble. An organic solvent which is inert to the reaction may be used advantageously; preferably it is also volatile so that it can be easily separated from the reaction product by distillation. Alcohols, hydrocarbons and other organic solvents may be used for this purpose. A preferred organic solvent is either dry or aqueous methanol or isopropanol.

Water also is a suitable solvent; however, water does not completely dissolve the reactants, and it wets the catalyst, which interferes with wetting by the organic reactants. The ethynylation reaction rate thus is slower in water than in an organic solvent which forms a single liquid phase. Mixtures of an organic solvent and water may be used, most suitably those which give a single reacting liquid phase.

In a typical run, a charge is made of the reactants in a molar ratio of about 1:1 of the secondary amine and 2-ethylhexanal in an alcoholic solvent. The charge then is heated to a temperature of about 70° to 115° C., preferably 85° to 105° C., and acetylene is introduced and maintained at the desired pressure. The reaction then is carried out for from less than 1 to 36 hours, generally for about 0.2 to 8 hours.

The crude reaction product then is separated from the catalyst, where necessary, stripped of solvent by rotary evaporation under reduced pressure and the crude reaction mixture is purified by fractional distillation under vacuum. Gas chromatographic (GC) assay indicates that the isolated compounds have a purity of at least 85%, and usually 95% or more. Some decomposition of the compound may occur, however, at the temperature of the assay.

The purified compound may be characterized by its IR and NMR spectra. The IR spectrum shows the presence of a strong sharp C—H stretching absorption band at about 3320 $cm^{-1}$, attributable to the ethynyl group, and an absence of carbonyl absorption in the region of 1600–1700 $cm^{-1}$. The NMR spectrum shows distinctive absorptions related to the

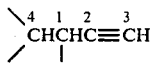

portion of the molecule. The C-1 proton is evident by a 4-CH doublet of doublets at 3.1–3.2 δ due to coupling of the C-3 proton with both the C=1 and C=4 protons. The C-3 proton also shows up as a doublet by coupling with the C-1 proton; however, at 2.0–2.2 δ. In addition, the NMR spectrum of the compounds herein reveals the absence of both an aldehyde proton absorption, which is present in the starting material at 9–10 δ, and any N—H absorption.

The crude ethynylation reaction product is a complex mixture which contains predominantly the two diastereoisomers of the 3-dialkylamino-3-(1-ethylpentyl)prop-1-yne, in the ratio of about 3:1 to 4:1 of each other; in addition, it may contain some of the corresponding di-compound, i.e. an N,N,N',N'-tetraalkylamino-1,4-bis-(1-ethylpentyl)-1,4-(2-butynediyl)diamine, having the formula:

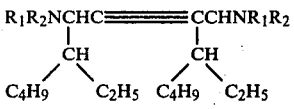

and, in addition, some 3-dialkylaminobutyne, e.g. $R_1R_2NCH(CH_3)C{\equiv}CH$, and, depending upon reaction conditions, unreacted starting materials, and lesser amounts of other materials.

The reaction product itself may be used as a corrosion inhibitor without purification or isolation of the predominate compound therein. This option is particularly attractive from a commercial standpoint, because of the economic feature, and, indeed, the reaction product may perform as well or better under stringent conditions than the predominate compound in pure form. This effect may be due to the presence of by-products in the reaction product which may act as a synergist with the predominate compound.

The corrosion-inhibiting compositions of the invention may be used at varying concentrations. What is an effective amount in a particular application will depend upon local operating conditions. For example, the temperature and other characteristics of the acid corrosion system will have a bearing upon the amount of inhibitor to be used. The higher the temperature and/or the higher the acid concentration, the greater is the amount of corrosion inhibitor required to give optimum results. In general, however, it has been found that the corrosion inhibitor composition of the invention should be employed at a concentration of between 0.01 and 2%, preferably between 0.01% and 1.2%, by weight of the aqueous acidic solution, although higher concentrations can be used when conditions make them desirable. An inhibitor concentration between 0.05% and 0.75% by weight is of the most general use, particularly at elevated temperatures, e.g. in the neighborhood of 200° F.

The acidic solution itself can be dilute or concentrated as desired, and can be of any of the specific concentrations customarily used in treating metals, e.g. ferrous metals, or for operations involving contact of acidic solutions with such metals in oil-well acidizing. Generally the acid content is about 5 to 80%, and, in most operations of the character indicated, acid concentrations of 10–15% by weight are employed. Non-oxidizing inorganic acids are the most common acids used.

The invention will now be described in more detail by the following example which is for illustration only, and not by way of limitation.

EXAMPLE

A charge is made to a 1-l. stirred autoclave consisting of 1 mole (129 g) of dibutylamine, 1 mole of 2-ethylhexanal (free of 2-ethylhexanoic acid) (128.0 g), 25 g of a 35 wt. % Cu-containing catalyst, prepared as described in U.S. Pat. No. 4,119,790, as a powder, and 350 ml of isopropanol.

The reactor is purged well with nitrogen, released to atmospheric pressure, and the reactants are heated to 95° C. The vapor pressure at this point is recorded. Acetylene then is admitted at a pressure of 100 psig above the recorded pressure. The amount of acetylene furnished to the reaction is measured by the loss in weight of the supply cylinder.

After about 12–24 hrs., corresponding to the absorption of 1 mole of acetylene (26 g), the reactor is cooled and the product is discharged. The reaction mixture is filtered to remove catalyst and stripped of solvent by rotary evaporation. Gas chromatographic analysis of the resulting crude reaction product mixture indicates it contains about 75% by weight of the combined diastereoisomers of 3-dibutylamino-3-(1-ethylpentyl)prop-1-yne. The crude mixture then is purified by distillation at 118° C. at about 2.5 mm to give the purified compound. Gas chromatographic assays indicates that the product is comprised to the extent of at least 88% of the two diastereoisomers.

The compounds of the present invention were tested in the usual way to determine their effectiveness as corrosion inhibitors. In such tests, strips of 1020 carbon steel of the dimensions 2.5"×1.0"×0.20" were first degreased with methylethyl ketone and then descaled by soaking in 10% hydrochloric acid solution containing approximately 0.1% propargyl alcohol. The coupons then were cleaned with a brush and thoroughly rinsed with water. After rinsing, the coupons were soaked in 2% sodium carbonate solution, rinsed successively with water and acetone and air dried. The surface dimensions of the cleaned coupons were determined with the vernier scale and the coupons were allowed to dry in a desiccator. Before use the coupons were weighed on an analytical balance.

The tests were carried out in a 4 oz. jar containing a weighed amount of the inhibitor. The total solution weight was taken to 100.0 g with the addition of 15% hydrochloric acid. The coupon then was then placed in the mixture and the jar loosely capped and placed in an 80° C. oil bath. After 16 hours the jar was removed from the oil bath and the contents were allowed to attain ambient conditions. The coupon was removed from the acid solution, thoroughly washed with water, 2% sodium carbonate solution, again with water, and finally rinsed with acetone. After air drying the coupon was kept in a desiccator before weighing and the net weight loss was calculated by the established procedure.

A control also was run using no inhibitor whatsoever, and, for comparative purposes, with other related compounds.

The test results are presented in the Table below, where a lower value of weight loss represent better corrosion inhibition.

TABLE

EFFECTIVENESS OF COMPOUNDS AND REACTION PRODUCTS OF INVENTION AS CORROSION INHIBITORS

| Compound | Wt. Loss (%) Pure Cmpd. | Wt. Loss (%) Rx. Prod. |
|---|---|---|
| Conditions of Test | | |
| 0.4% inhibitor; 15% HCl; 16 hrs; 80° C. | | |
| 3-Dibutylamino-3-(1-ethylpentyl)prop-1-yne | 0.21 | 0.16 |
| 3-(N—Methyl-N—phenylamino)-3-(1-ethylpentyl)prop-1-yne | | 0.20 |
| 3-Dihexylamino-3-(1-ethylpentyl)prop-1-yne | | 1.05 |
| 3-Dimethylamino-3-(1-ethylpentyl)prop-1-yne | | 0.25 |
| 3-Dibutylamino-3-cyclohexylprop-1-yne* | | 1.25 |
| 3-Dibutylaminoprop-1-yne* | | 1.90 |
| 3-Dibutylamino-3-methylprop-1-yne* | 1.18 | 1.82 |
| 3-Dibutylamino-3-propylprop-1-yne* | | 3.15 |
| 3-Dimethylamino-3-(1-methylethyl)prop-1-yne* | | 4.50 |
| No Inhibitor | 26.50 | |

*Comparative tests

As is seen from the data in the Table, the 3-dialkylamino-3-(1-ethylpentyl) compounds of the invention exhibit excellent corrosion inhibition for metal in aqueous acid solution. These compounds perform substantially better than the corresponding dialkylamino compounds which are unsubstituted at the 3-position, or which contain lower alkyl substitutions, either straight chain, branched chain or cyclic. This result is attributable primarily to the long chain alkyl group and its branching groups at the 1-position.

While the invention has been described with reference to certain embodiments thereof, it will be understood that modifications and changes may be made which are within the skill of the art. Accordingly, it is intended to be bound by the following claims in which:

What is claimed is:

1. An aqueous composition for inhibiting the corrosion of metals placed therein comprising:

(a) an effective amount of a corrosion-inhibiting compound having the formula:

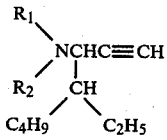

where $R_1$ and $R_2$ are independently alkyl $C_1$–$C_6$, or phenyl; and (b) a non-oxidizing acid.

2. A composition according to claim 1 wherein both $R_1$ and $R_2$ are the same.

3. A composition according to claim 1 in which said compound is 3-dibutylamino-3-(1-ethylpentyl)prop-1-yne.

4. A composition according to claim 1 in which said compound is 3-(N-methyl-N-phenylamino)-3-(1-ethylpentyl)prop-1-yne.

5. A compound of the formula:

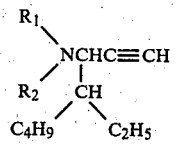

where $R_1$ and $R_2$ are independently alkyl $C_1$–$C_6$ or phenyl.

6. A compound according to claim 5 wherein both $R_1$ and $R_2$ are the same.

7. A compound according to claim 5 which is 3-dibutylamino-3-(1-ethylpentyl)prop-1-yne.

8. A compound according to claim 5 which is 3-(N-methyl-N-phenylamino)-3-(1-ethylpentyl)prop-1-yne.

9. A corrosion inhibitor for aqueous solutions of mineral acids consisting essentially of the reaction product obtained by the catalytic ethynylation of a secondary amine $R_1R_2NH$, where $R_1$ and $R_2$ are independently alkyl $C_1$–$C_6$ or phenyl, and 2-ethylhexanal, with acetylene.

10. A reaction product according to claim 9 which contains a predominate amount of a 3-dialkylamino-3-(1-ethylpentyl)prop-1-yne compound.

11. A reaction product according to claim 9 which contains a predominate amount of a 3-(N-methyl-N-phenylamino)-3-(1-ethylpentyl)prop-1-yne.

12. A reaction product according to claim 9 wherein in said compound both $R_1$ and $R_2$ are the same.

13. A reaction product according to claim 9 which contains predominantly 3-dibutylamino-3-(1-ethylpentyl)prop-1-yne.

14. A reaction product according to claim 9 in which said ethynylation is carried out in a solvent.

15. A reaction product according to claim 14 in which both said solvent and catalyst are removed after said reaction.

16. A reaction product according to claim 9 in which said ethynylation is carried out using a catalyst comprising a complex cuprous acetylide prepared from a precursor containing about 5 to 35% by weight of copper, and 2–3% by weight of bismuth, as the oxides, on a magnesium silicate carrier, at a pressure of about 0.1 to 20 atmospheres, at about 70° to 115° C., in an organic solvent selected from alcohols, ketones and amides, in molar ratio of about 1:1 of a dialkylamine or aniline to 2-ethylhexanal, for from about 0.2 to 36 hours, and the solvent is removed from the crude reaction product, said product containing a predominate amount of a 3-dialkylamino-3-(1-ethylpentyl)prop-1-yne or 3-alkylphenylamino-3-(1-ethylpentyl)prop-1-yne.

17. An aqueous acidic solution inhibited to corrosion of metal consisting essentially of an effective amount of the reaction product as defined in claim 9.

18. A method of inhibiting the corrosive action of an aqueous solution of a non-oxidizing acid on a metal, comprising maintaining an effective amount of the corrosion inhibitor as defined in claim 9 in said solution.

* * * * *